US006732465B2

(12) United States Patent
Strayer

(10) Patent No.: US 6,732,465 B2
(45) Date of Patent: May 11, 2004

(54) FIREARM MECHANISM HAVING SLIDE WITH INTERCHANGEABLE BREECH FACE

(76) Inventor: Sandy L. Strayer, 7409 Boca Raton, North Richland Hills, TX (US) 76180

( * ) Notice: Subject to any disclaimer, the term of this patent is extended or adjusted under 35 U.S.C. 154(b) by 0 days.

(21) Appl. No.: 09/982,500

(22) Filed: Oct. 18, 2001

(65) Prior Publication Data

US 2002/0178632 A1 Dec. 5, 2002

Related U.S. Application Data

(63) Continuation of application No. 09/227,326, filed on Jan. 6, 1999, now abandoned.
(60) Provisional application No. 60/070,868, filed on Jan. 9, 1998.

(51) Int. Cl.[7] ..... F41A 3/12
(52) U.S. Cl. ..... 42/69.03; 42/22; 42/25
(58) Field of Search ..... 42/20, 21, 22, 42/25, 69.02, 69.03

(56) References Cited

U.S. PATENT DOCUMENTS 2,950,653 A * 8/1960 Harvey ..... 89/185
5,345,854 A * 9/1994 Schieferie et al. ..... 89/26
5,806,226 A * 9/1998 Norton et al. ..... 42/84

* cited by examiner

*Primary Examiner*—Stephen M. Johnson
(74) *Attorney, Agent, or Firm*—Andrews Kurth LLP

(57) ABSTRACT

A firearm, such as a handgun, rifle, machine gun, etc. has a frame assembly having a barrel defining a cartridge chamber and includes a magazine for serially positioning cartridges at a pickup location relative to said frame assembly and barrel. A reciprocating member, such as a slide or bolt is provided in the firearm assembly for moving cartridges from said pickup location into the cartridge chamber of the barrel and for extracting the cartridge cases of spent cartridges from the cartridge chamber and ejecting them from said firearm. The reciprocating member is machined to define a breech face recess. A cartridge specific breech face element is removably secured within the breech face recess to adapt the firearm to fit a cartridge of desired caliber and configuration. The breech face element can be provided in specifically desired dimensions to compensate for wide tolerances or wear of the reciprocating member.

18 Claims, 2 Drawing Sheets

FIREARM MECHANISM HAVING SLIDE WITH INTERCHANGEABLE BREECH FACE

This application is a continuation of copending application(s) application Ser. No. 09/227,326 filed on Jan. 6. 1999 now abandoned.

The non-provisional application designated above, namely application Ser. No. 09/227,326, filed Jan. 6. 1999, claims the benefit of U.S. Provisional Application(s) No(s).: 60/070,868 Jan. 9. 1998 now abandoned.

BACKGROUND OF THE INVENTION

1. Field of the Invention

The present invention relates generally to firearms having reciprocating cartridge handling elements such as slides or bolts and which are manually or automatically operated for feeding cartridges from a magazine to the cartridge chamber of a firearm barrel and for extracting and ejecting the cases of spent cartridges. More specifically, the present invention finds application in semi-automatic handguns of the general character of the standard United States Government model 1911 A1 handgun. Even more particularly, the present invention has effective application in semi-automatic handguns of the type having a gas energized, spring returned reciprocating slide which feeds cartridges from a cartridge magazine into the cartridge chamber of the handgun barrel during its forward or returned movement and which extracts and ejects the cartridge cases of spent cartridges from the cartridge chamber of the handgun barrel during its rearward or recoil movement. Even more particularly, the present invention concerns a reciprocating handgun slide or bolt of a semi-automatic handgun or other firearm, wherein the slide or bolt defines a breech face seat recess and wherein a replaceable breech face element is retained within the breech face seat recess to adapt the slide or bolt for a cartridge of desired caliber and configuration and to enable a user of the firearm to simply and efficiently replace a worn breech face without necessitating replacement or repair of the slide or bolt.

2. Description of the Prior Art

Though the present invention is discussed herein particularly as it relates to handguns which incorporate features and functional components based on the 1911 A1 Government Model handgun, it is to be understood that such discussion is intended solely to promote an understanding of this invention. Within the spirit and scope of the present invention it is to be appreciated that the present invention has application in many other types of firearms, including shoulder fired firearms, machine guns, handguns and firearms with bolts or slides that are manually or automatically operated for cycling cartridges from magazines into the firearm and for extracting and ejecting the cartridge cases of expended cartridges. The term "slide" as used herein is intended to mean any device that is utilized to move a cartridge or shell from a magazine into the cartridge chamber of a firearm barrel and to extract spent cartridge cases or shell hulls from the cartridge chamber and includes the slides of handguns, the bolts of rifles, machine guns whether of automatic or manual operation.

The 1911 A1 Government Model handgun has been widely manufactured for many years, particularly for military and police use as well as for personal use and early on was historically adapted only for a .45 caliber ACP cartridge. The single cartridge aspect of the Government Model 1911 A1 handgun has been accomplished over the years simply by machining the slide of the handgun internally to define a breech face that is adapted specifically for the .45 caliber ACP cartridge. Subsequently, the Government Model 1911 A1 type handgun has been adapted for cartridges of many other calibers and configurations by machining the slide of the handgun with a breech face that is designed for handling a cartridge of the particular caliber and configuration that is intended to be handled by the handgun mechanism. Thus, a manufacturer intending to provide the Government Model 1911 A1 type handgun in the various varieties for handling the significant number of cartridges that are presently available, is required to maintain a wide variety of cartridge specific handgun slides to maintain customer satisfaction. Obviously, maintenance of a significant inventory of cartridge specific firearm slides is an expensive proposition that adversely affects the commercial aspects of the firearm business.

It is well known that the Government Model 1911 A1 type handgun lends itself readily to changes of ammunition, typically by changing out barrels, slides and other components. Thus, if a user of a handgun should desire to alter the handgun for utilization of different cartridges or calibers it would be necessary to change out the barrel and to replace the slide of the handgun with a slide that had been machined for that particular cartridge. Since the slide of this type of handgun is one of the more expensive components of the handgun, conversion of a handgun in this manner is sufficiently expensive that it is seldom done. Additionally, to provide for handgun conversion by customers, it is desirable that manufacturers maintain a significant inventory of cartridge specific handgun slides as well as barrels and other conversion components for the range of cartridges and calibers that might be desired by handgun users. Maintaining such an inventory by persons or companies involved in handgun conversion is a relatively expensive proposition due to the wide variety of cartridges that have become available for employment in the basic Government Model 1911 A1 semi-automatic handgun and those hybrid varieties that have been developed utilizing the basic concept of operation that is employed by that particular handgun.

Typically. Government Model 1911 A1 semi-automatic handguns have a rather loose fit of mechanical components to provide for reliability when subjected to use in field conditions. In the field, particularly for military use, the mechanical components of the Government Model 1911 A1 are subjected to water, mud, dirt, dust, and other contaminants that are typically present. Because of the loose fit of its components this type of handgun typically has limitations from the standpoint of accuracy. Recently, however, the basic Government Model 1911 A1 semi-automatic handgun has found wide application in shooting match conditions where greater accuracy is required as compared to the range of accuracy that is typically available in the Government Model handgun. To gain such accuracy the various components of the handgun, which typically are machined to conditions of wide tolerance to accommodate the hazards of field conditions, are hand fitted and honed or otherwise prepared for the tight fit of components that are necessary to promote accuracy of shooting in both slow fire and rapid fire match conditions. Since match grade handguns are typically utilized under controlled conditions and are maintained clean and free of debris and other contaminations and well lubricated at all times, tight fitting handgun mechanisms are the rule rather than the exception for use in match conditions.

When a slide action handgun is utilized, such as the Government Model 1911 A1 semi-automatic handgun, the machined breech face of the slide is subject to significant impact as the rear or rim of the cartridge is driven against the breech face by the high pressure gas that is present in the cartridge when the gunpowder is ignited by the primer of the cartridge. The impact force of the cartridge against the breech face can be in the order of 10,000 psi or greater depending on the character of the cartridge that is fired. Although a handgun slide of this nature is typically hardened during its manufacture to withstand damage by such impact forces, nevertheless, under match conditions, where high volume firing typically occurs, the repetitive impacts of cartridge cases against the breech face will, in time, cause deformation and wear of the slide. This wear, of course, will adversely affect the accuracy of the handgun so that, in time, the user will be required to replace the slide with a new one. At this time it will also be appropriate to replace or refit the barrel of the handgun with the replacement slide because the accuracy of the resulting slide replacement will often result in handgun inaccuracy unless a proper fit is established between the barrel and replacement slide. Other handgun components will also need replacement when the slide is replaced so that the resulting repair will establish a proper fit between mechanical components that is necessary for match grade accuracy. Thus, replacement of the slide in a match grade handgun can amount to substantial reconstruction of the handgun. This is a very expensive procedure both from the standpoint of material and labor. It is desirable, therefore, to provide a handgun slide that can be readily repaired when its breech face has become worn and to do so without requiring replacement of the barrel, guide bushings, or other components that influence the accuracy of the handgun.

SUMMARY OF THE INVENTION

It is a principal feature of the present invention to provide a novel handgun mechanism having a slide that may be repaired simply and efficiently and at low cost without necessitating replacement of the slide;

It is also a feature of the present invention to provide a novel semi-automatic handgun mechanism having a slide that is adapted to receive a replaceable breech face to enable the breech face of the slide to be repaired without necessitating machining or replacements of other slide components;

It is another feature of the present invention to provide a novel semi-automatic handgun mechanism having a slide that is machined with a breech face recess so that a replacement breech face element may be secured within the breech face recess by screws or by other suitable means to enable simple and efficient repair of the handgun slide;

It is an even further feature of the present invention to provide a novel semi-automatic handgun mechanism which incorporates a reciprocating slide which is adapted for breech face replacement to thereby enable the slide to be simply and efficiently repaired or modified for a different cartridge without requiring slide replacement or replacement of any of the handgun components that contribute to the accuracy of shooting.

Briefly, the various objects and features of the present invention are realized by providing firearms, such as a handguns, rifles, machine guns or the like having reciprocating slides or bolts that are manually or automatically operated for cycling cartridges from magazines into the firearms and for extracting and ejecting the cartridge cases of expended cartridges. The slides or bolts of the firearms will be machined or otherwise formed to define a breech face recess. A replaceable breech face element will be removably secured within the breech face recess by means of one or more connector screws or by any other suitable connector means. In the event the replaceable breech face of a slide or bolt of a firearm should become worn, the user will extract the connector screws and replace the worn or damaged breech face element with a new one. It will not be necessary to replace, repair or refit any of the other mechanical components of the firearm and the breech face replacement operation will not influence the accuracy of the firearm.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is an elevational view showing a handgun employing the features of the present invention;

FIG. 2 is an elevational view showing the slide of the handgun of FIG. 1 separated from the frame assembly of the handgun;

FIG. 3 is a partial bottom plan view of the firearm slide of FIGS. 1 and 2 having parts thereof broken away and shown in section and showing the relationship of the breech face element, breech face retainer, cartridge extractor and firing pin in relation to the structure of the slide;

FIG. 4 is a partial bottom plan view of the slide of FIG. 2, showing the breech face element in alignment with, but not fully seated within, the breech face recess of the slide;

FIG. 5 is a partial bottom plan view of the slide of FIGS. 2, 3, and 4, showing the breech face element being fully seated within the breech face recess;

FIG. 6 is an isometric illustration showing a breech face element for positioning within the breech face recess shown in FIGS. 3 and 4; and FIG. 7 is an elevational view showing the breech face element of FIG. 6.

DETAILED DESCRIPTION OF PREFERRED EMBODIMENT

Figure 1:
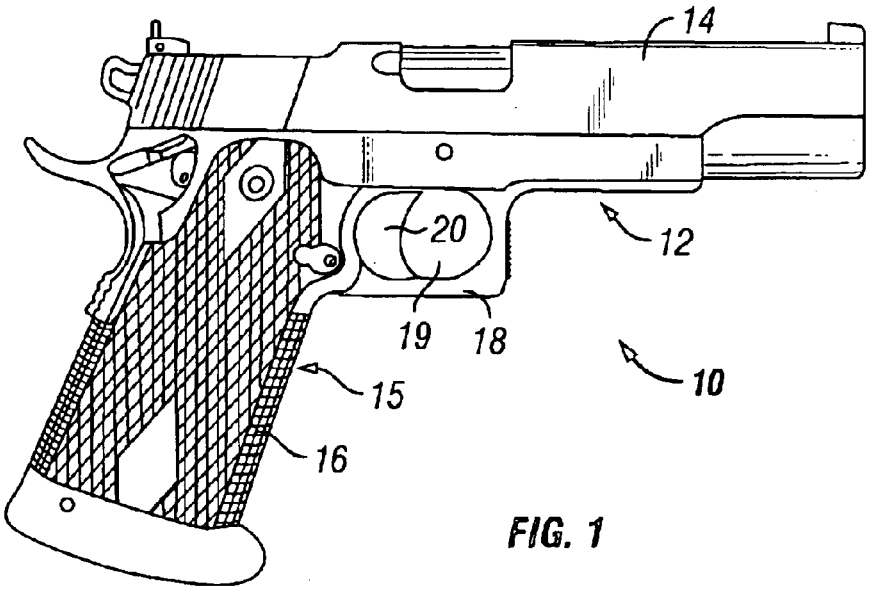

Referring now to the drawings and first to FIG. 1, a handgun embodying the principles of the present invention is shown generally at 10 and thus incorporates a frame assembly shown generally at 12 which defines guide rails for receiving a slide 14 in reciprocating relation therewith. The frame assembly 12 is provided with a handgrip unit shown generally at 15 having a handgrip 16 and a trigger guard 18 within which a trigger shoe part 20 of a trigger element is movably positioned. For purposes of simplicity, it is to be understood that the handgun 10 is merely representative of a type of firearm within which the present invention may be embodied. The handgun mechanism 10 is not described in detail, it being understood that the handgun shown is of the general character of the magazine fed Government Model 1911 A1 semi-automatic handgun and thus incorporates the basic operating mechanism thereof. The handgun 10 that is shown in FIG. 1 is, however, a match grade magazine fed, semi-automatic handgun wherein the handgrip unit 15, including its handgrip 16 and trigger guard 18 are integral and composed of a polymer material having metal inserts that establish mating interconnection with insert receptacles located on opposed sides of the frame of the firearm assembly. The handgrip and trigger guard unit 15 is secured in fixed assembly with the frame assembly 12. The frame of the firearm defines guide rails with which the slide member 14 has interfitting, longitudinally movable, reciprocating relation. Additionally, the handgrip section 16 of the handgrip unit 15 may define a wide magazine opening, permitting the use of an enhanced volume, staggered row type magazine for containing and feeding cartridges. With regard to the present invention however, it is to be understood that the present invention may be incorporated within the magazine fed Government Model 1911 A1 semi-automatic handgun, without any change thereto other than specific machining of the slide thereof to define a breech face recess of the nature discussed herein and by securing a removable breech face element within the breech face recess as will be discussed in detail hereinbelow.

Figure 2:
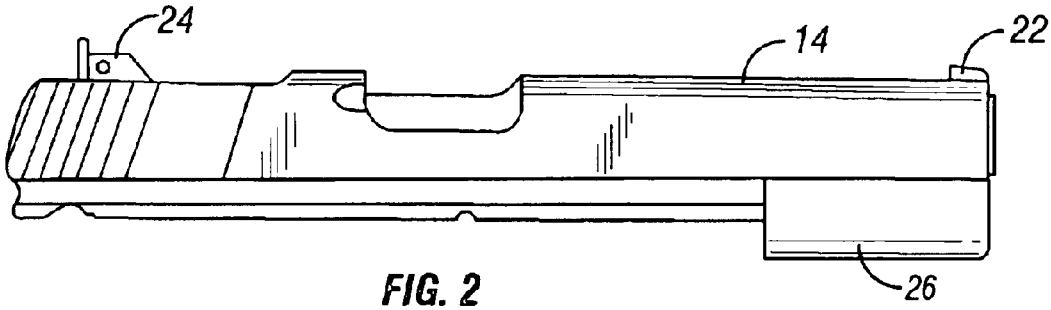

Referring now to FIG. 2, the slide 14 is provided with a front sight 22 and a rear sight 24. Typically, the front sight 22 is secured in fixed relation with the slide 14 and the rear sight 24 may be of the fixed variety or may have selectively and controllably movable components to permit sight adjustment according to the wishes of the user. The handgun may also be provided with laser or telescopic sight mechanism which is typically supported by a sight mount being fixed by screws or by any other connection means to the frame structure of the handgun. The front portion of the slide 14 defines a generally tubular bushing receptacle 26 having a guide bushing that has bearing and guiding relation with a guide rod. As the slide is driven rearwardly against the force of its compression spring by the force of gas pressure from a fired cartridge, the guide bushing assists the guide rails of the frame in providing a guiding function for guiding the rearward or recoil movement of the slide 14. The guide rod and guide bushing also control the position of the barrel with respect to the frame of the handgun and therefore, when the slide is at its forward most position, the closeness of the fit between the guide rod and guide bushing influence the accuracy of the handgun to a significant extent.

Figure 3:
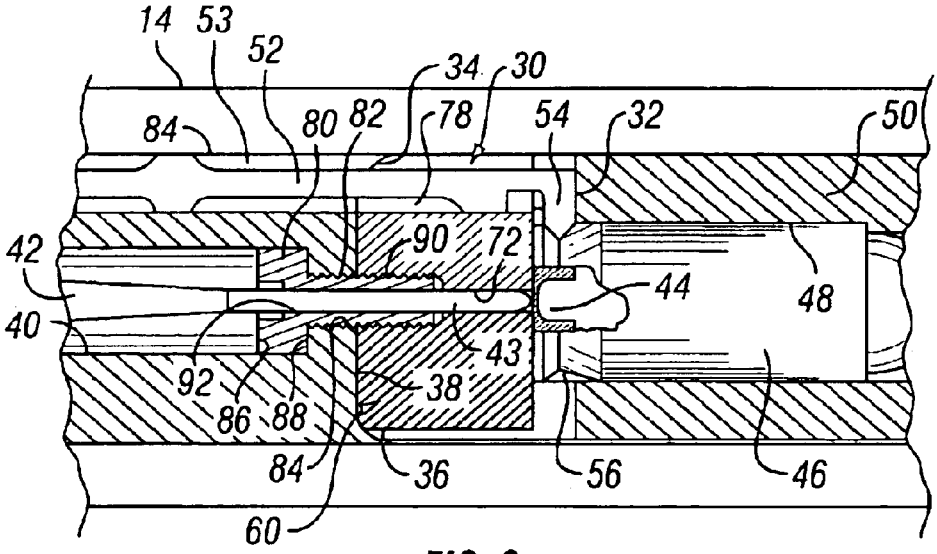

Referring now to FIG. 3, the slide member 14 of the handgun 10 is shown by way of partial bottom view with parts thereof broken away and shown in section and illustrating the relationship of various components of the firearm to the slide. The slide is machined or otherwise formed to define a breech face recess shown generally at 30. The breech face recess 30 is defined by a curved upper surface 32 and by transversely curved force transmitting shoulder surfaces 34 and 36 which mate with a substantially planar central surface section 38. The slide member 14 is machined to define a firing pin passage 40 within which is located a firing pin 42 which is forwardly movable by the hammer of the frame assembly for striking the primer 44 of a cartridge 46 located within the cartridge chamber 48 of a firearm barrel 50 which is secured within the frame assembly. An extractor element 52 is located within an extractor bore 53 of the slide element and is provided with a cartridge engaging end 54 which is adapted to engage within the rim groove 56 of the cartridge 46. The rim groove of the cartridge is a circular groove with inclined surfaces, and is located adjacent the base of the cartridge case. It should be borne in mind however, that the cartridge engaging end of the extractor element may be of a different configuration which is defined by the geometry of the particular cartridge to be handled by the firearm.

Figure 5:
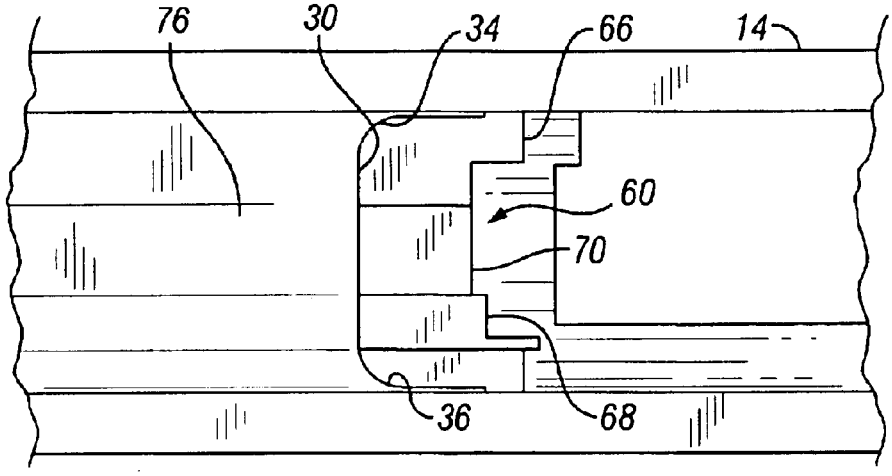
Figure 6:
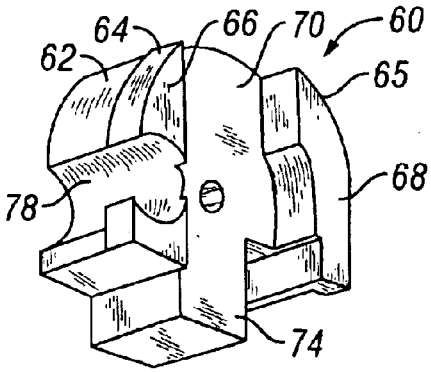
Figure 7:
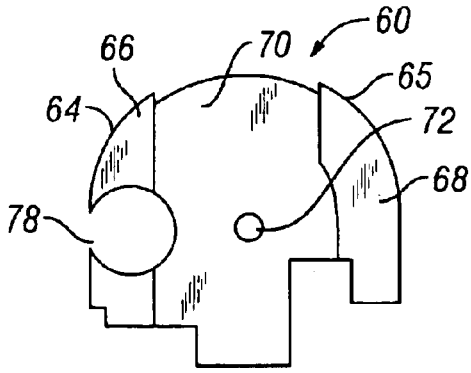

As shown in FIGS. 3 and 5 and also shown in FIGS. 6 and 7, a breech face element shown generally at 60 is receivable in intimate fitting relation within the breech face recess 30 of the slide member 14 and is disposed in force transmitting surface to surface engagement with various recess surfaces so that the force of recoil is transmitted efficiently through the breech face element to the slide. The breech face element 60 is cartridge specific in that its cartridge engaging surface 70 is designed to fit the base or rim of the particular cartridge being used. Further, the slide 12 may be adapted for a different cartridge simply by changing out the breech face element for one that is specifically designed for a different cartridge or range of cartridges. The breech face element 60, as best seen in FIGS. 6 and 7, defines curved surfaces 62 and curved or contoured bearing or guide bosses 64 and 65 that project slightly beyond the curved surface 62 at respective side portions of the breech face insert. When the breech face element is seated within the breech face recess 30 the curved or contoured guide bosses 64 and 65 will be in engagement with the curved upper internal surface 32 of the slide 14 and the curved surface 62 will be disposed in spaced relation with the curved upper internal surface 32.

Figure 4:
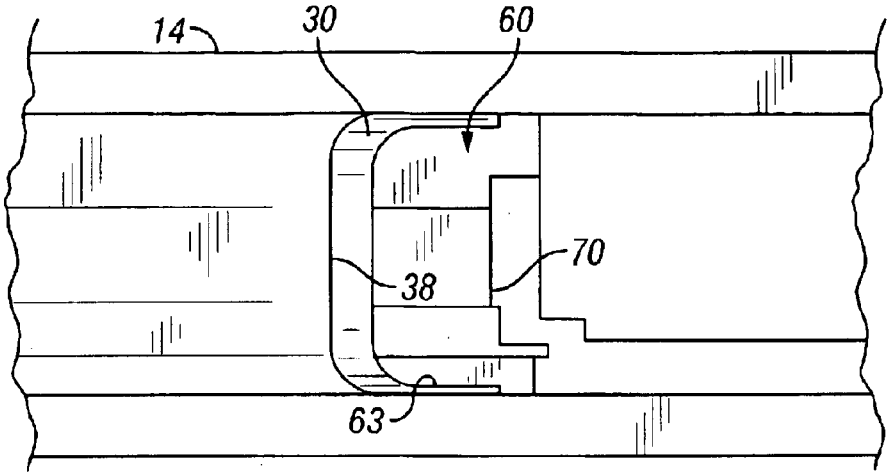

The breech face element 60 defines forwardly facing bosses 66 and 68 which are machined or otherwise formed to define the cartridge specific aspects of the breech face element and which are located on lateral sides of the breech face element and have intersecting relation with a generally planar forwardly facing cartridge engaging surface 70. The lateral edges of the bosses 66 and 68 define the guide bosses 64 and 65 as shown. The breech face element 60 also defines a firing pin passage 72 through which the forward end 43 of the firing pin 42 is movable. The passage 72 provides a guide for the firing pin to position its forward end for striking the primer 44 of the cartridge 46. The breech face element 60 also defines a bottom generally rectangular boss 74 which is received in alignment with an internal rib 76 of the slide as seen in FIGS. 4 and 5 when the breech face element is fully seated within its recess 30.

To provide for access of the extractor 52 to the cartridge rim groove the interchangeable breech face element 60 defines an extractor recess 78 which is located at one side of the breech face element 60 as shown in FIGS. 6 and 7 and which is in registry with, the extractor bore 53. The extractor 52 extends through the extractor recess 78 so that the cartridge engaging portion or "claw" 54 of the extractor is positioned for engagement within the rim groove 56 of a cartridge present within the cartridge chamber of the firearm barrel. When the recoil force of the discharged cartridge drives the slide member rearwardly against the force of the spring of the slide member, the extractor 52 will travel with the slide member, with its cartridge engaging end or "claw" 54 remaining engaged within the rim groove 56 of the cartridge and with a portion of the extractor located within the extractor bore or recess 78 of the interchangeable breech face element, which is fixed to and travels with the slide member. During this: rearward or recoil slide movement the extractor 52 and its claw 54 will pull the spent cartridge case from the cartridge chamber of the firearm barrel. This causes the spent cartridge case to travel along with the rearwardly moving slide member until the cartridge case contacts a stop member of the handgun frame. With the rearward movement of the cartridge case stopped and with the slide and extractor continuing to move rearwardly, the cartridge case will be pivoted about the claw member 54, causing the cartridge to be released from the extractor and ejected sidewise through an ejection opening 13 of the slide member. The extractor recess 78 of the interchangeable breech face element 60 thus permits the extractor 52 to provide its function of extracting spent cartridge cases from the cartridge chamber of the barrel during recoil movement of the slide member.

For securing the breech face element in intimate force transmitting relation with the slide, a retainer screw 80, which preferably defines an Allen seat for actuation by a conventional Allen wrench, has an external threaded section 82 which is received by an internally threaded opening 84 of the slide. The retainer screw 80 defines a screw head 86 which seats against an internal shoulder 88 which is defined at the forward end of the firing pin passage 40 of the slide. Thus, the retainer screw secures the breech face element in intimate, seated relation within the breech face recess. It should be noted that the retainer screw is not required to accommodate forces transmitted to the slide element during firing of the firearm. The retainer screw merely serves the function of maintaining the breech face insert properly seated within the breech face recess of the slide member. When so seated, the forces of firing are transmitted from the cartridge to the breech face insert and progress through the surface to surface contact of the breech face insert with the rearmost breech face recess surfaces 34, 36 and 38 into the reciprocating slide. The forward threaded end of the retainer screw 82 is received in threaded engagement within an internally threaded opening 90 of the breech face insert element 60 as shown in FIG. 3. The retainer screw 80 is tightened against the shoulder 88 by inserting an Allen wrench or other tool through the firing pin passage 40 of the slide 14.

The retainer screw 80 also defines a central bore 92 being a firing pin passage through which the forward end 43 of the firing pin 42 extends. With the retainer screw 80 in place as shown in FIG. 3 its firing pin passage 92 is in registry with the firing pin passage 72 of the breech face insert element 60 so that the forward end 43 of the firing pin extends through the registering passages 92 and 72 and is guided thereby.

The breech face insert 60 is capable of being utilized for dimension compensation of the slide. A user, having a firearm with a particular size dimension, length for example, can achieve precision fit with other firearm components by utilizing a breech face insert having a desired dimension. An insert supplier will only need to know the precise length of the slide and insert that is desired. The breech face insert can then be chosen from a number of sizes or can be made on special order to achieve the precision dimension that is desired. This is a very important factor from the standpoint of competitive or match shooting. This feature permits the slide to be manufactured with wide tolerance to achieve low cost and yet permits the assembly of a match grade firearm by using a particular size breech face insert to compensate for such factors as wide tolerances, slide wear, slide deformation, etc.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. A semi-automatic handgun type firearm mechanism comprising:

(a) a frame assembly having a barrel defining a cartridge chamber;

(b) a magazine for serially positioning cartridges at a pickup location relative to said frame assembly and barrel;

(c) a recoil actuated spring returned reciprocating slide member for moving cartridges from said pickup location into said cartridge chamber and for extracting the-cartridge cases of spent cartridges from said cartridge chamber and ejecting the same from said firearm said reciprocating slide member defining an end face and having an insert receptacle therein defining side walls and an internal force transmitting surface and intersecting said end face, said reciprocating member having a retainer shoulder;

(d) an interchangeable breech face insert being located within said insert receptacle of said reciprocating member and having intimate surface to surface force transmitting engagement with said internal force transmitting surface, said breech face element being adapted to fit a cartridge of desired caliber and configuration and having a firing pin opening and threaded retainer opening therein; and (e) a retainer element being received by said threaded retainer opening and releasably securing said interchangeable breech face insert in force transmitting relation within said insert receptacle.

2. The semi-automatic handgun type firearm mechanism of claim 1, wherein:

(a) said internal force transmitting surface of said reciprocating member defining an internal recoil force transmitting surface geometry; and (b) said interchangeable breech face element having a matching external force transmitting surface geometry having intimate, substantially fixed surface to surface relation with said recoil force transmitting geometry.

3. The semi-automatic handgun type firearm mechanism of claim 1, wherein:

(a) said interchangeable reciprocating slide member defining said retainer shoulder; and (b) said retainer element being a retainer screw having a screw head for retaining engagement with said retainer shoulder for securing said interchangeable breech face element within said insert receptacle of said reciprocating member.

4. The semi-automatic handgun type firearm mechanism of claim 3, wherein:

(a) said reciprocating slide member defining an internal connection passage and having said retainer shoulder therein;

(b) an internally threaded opening defined within said interchangeable breech face element; and (c) said retainer screw being received within said internally threaded opening and having a screw head having releasable retaining engagement with said retainer shoulder, said retainer screw having a firing pin passage therethrough.

5. The semi-automatic handgun type firearm mechanism of claim 4, wherein:

(a) said interchangeable breech face element defining an extractor recess at one side thereof; and (b) an extractor element being provided within said frame assembly and having a portion thereof located for relative movement within said extractor recess.

6. The semi-automatic handgun type firearm mechanism of claim 3, wherein:

(a) a firing pin being movable within said frame assembly for striking a primer of a one of the cartridges when located within said firing chamber of said barrel;

(b) an internally threaded opening being defined by said interchangeable breech face element;

(c) an internal firing pin passage being defined by said reciprocating slide member;

(d) said retainer shoulder being defined by said reciprocating slide member and being located within said internal firing pin passage; and (e) said retainer element comprising a retainer screw being located within said internal firing pin passage and having a threaded section being received by said internally threaded opening and, said retainer screw having a screw head engaging said retainer shoulder and securing said interchangeable breech face element within said insert receptacle of said reciprocating slide member, said retainer screw defining a firing pin passage receiving a portion of said firing pin in movable relation therein.

7. The semi-automatic handgun type firearm mechanism of claim 1, wherein:

(a) said reciprocating slide member defining a breech face seat recess and defining a firing pin passage and having said retainer shoulder within said firing pin passage; and (b) said interchangeable breech face element being removably positioned within said breech face seat recess and having a threaded retainer opening therein; and (c) said retainer element comprising a retainer screw element being located within said firing pin passage and having threaded engagement within said threaded retainer opening and having a screw head engaging said retainer shoulder and retaining said interchangeable breech face element in removable, substantially fixed relation within said breech face seat recess.

8. The semi-automatic handgun type firearm mechanism of claim 7, wherein:

(a) said frame assembly having a firing pin adapted for striking a primer of a cartridge when located within said cartridge chamber of said barrel; and (b) said retainer screw element defining a firing pin passage receiving a portion of said firing pin in moveable relation therein.

9. The semi-automatic handgun type firearm mechanism of claim 1, wherein:

(a) said frame assembly having an extractor element adapted for extracting engagement with a cartridge when located within said cartridge chamber; and (b) said interchangeable breech face element defining an extractor recess receiving a portion of said extractor element therein.

10. A semi-automatic handgun mechanism, comprising:

(a) a handgun frame having a barrel defining a cartridge chamber and having a firing pin in moveable assembly therewith;

(b) a magazine being receivable in releasable assembly with said handgun frame for serially positioning cartridges at a pickup location relative to said frame and barrel;

(c) a spring urged recoil operated reciprocating slide member having reciprocating assembly with said handgun frame for moving cartridges from said pickup location into said cartridge chamber and for extracting the cartridge cases of spent cartridges from said cartridge chamber, said spring urged recoil operated reciprocating slide member defining a firing pin passage therein and having an internal retainer shoulder;

(d) a breech face recess being defined within said reciprocating slide member;

(e) an interchangeable breech face element being removably located within said breech face recess, said interchangeable breech face element being adapted to fit a cartridge of desired caliber and configuration and defining a firing pin passage having a portion of said firing pin moveably located therein; and (f) a retainer screw having threaded engagement with said interchangeable breech face element and having a screw head engaging said internal retainer shoulder and releasably retaining said interchangeable breech face element within said breech face recess.

11. The semi-automatic handgun mechanism of claim 10, wherein:

(a) said breech face recess of said reciprocating slide member having an internal recoil force transmitting geometry; and (b) said interchangeable breech face element having a matching external force transmitting geometry having intimate, substantially fixed surface to surface contact relation with said internal recoil force transmitting geometry of said breech face recess.

12. The semi-automatic handgun mechanism of claim 10, wherein:

said retainer screw defining a firing pin passage receiving a portion of said firing pin in movable relation therein.

13. The semi-automatic handgun mechanism of claim 10 wherein:

(a) a cartridge extractor being located within said reciprocating slide member and having a cartridge engaging end adapted to be received within a rim groove of a cartridge case located within said cartridge chair;

(b) said reciprocating slide member defining a connection recess having said internal retainer shoulder;

(c) an internally threaded opening being defined within said interchangeable breech face element;

(d) a said retainer screw engaging within said internally threaded opening and having a screw head in retaining engagement with said internal retainer shoulder and securing said interchangeable breech face element within said breech face recess; and (e) said interchangeable breech face element defining an extractor recess receiving a portion of said cartridge extractor therein.

14. The semi-automatic handgun mechanism of claim 10 wherein:

(a)said reciprocating slide member having a firing pin passage defining said internal retainer shoulder therein;

(b) said firing pin being movable within said firing pin passage for striking a primer of a cartridge located within said firing chamber;

(c) an internally threaded opening being defined in said interchangeable breech face element; and (d) said retainer screw being located within said firing pin passage of said reciprocating slide member and having a retaining head engaging said internal shoulder and securing said interchangeable breech face element within said breech face recess of said reciprocating slide member, said retainer screw defining a firing pin passage section; and (e) when said interchangeable breech face element is retained in secured relation within said breech face recess of said reciprocating slide member, a portion of said tiring pin being movable within said firing pin passage section.

15. The semi-automatic handgun mechanism of claim 11, wherein:

(a) said reciprocating slide member having an extractor element therein adapted for extracting engagement with a cartridge located within said cartridge chamber; and (b) said interchangeable breech face element defining an extractor recess receiving a portion of said extractor element therein.

16. A cartridge handling reciprocating slide assembly of a semi-automatic handgun mechanism having a firearm frame, comprising:

(a) an elongate reciprocating slide member adapted for guided relation with said firearm frame and defining an internal breech face recess having an internal recoil force transmitting geometry, said elongate reciprocating slide member defining a firing pin passage having a firing pin moveable therein and defining an internal retainer shoulder therein about said firing pin passage;

(b) an interchangeable breech face element being located within said breech face recess and having an external force transmitting surface geometry disposed is surface to surface recoil force transmitting engagement with said internal recoil force transmitting geometry of said breech face recess, said interchangeable breech face element having a threaded opening therein; and (c) a retainer screw having a screw head in retaining engagement with said internal retainer shoulder of said elongate reciprocating slide member and having releasable retaining engagement with said interchangeable breech face element and releasably retaining said interchangeable breech face element seated in recoil force transmitting relation within said internal breech face recess.

17. The cartridge handling member of claim 16, wherein:

(a) said breech face recess being defined by a centrally located generally planar force transmitting surface and by curved side force transmitting surfaces extending from respective sides of said centrally located generally planar force transmitting surface; and (b) said interchangeable breech face element having a rear force transmitting surface configuration having surface to surface matching recoil force transmitting relation with said centrally located generally planar force transmitting surface and said curved side force transmitting surfaces.

18. The cartridge handling member of claim 16, wherein:

(a) said elongate reciprocating slide member defining a extractor passage having a cartridge extractor located therein; and (b) said retainer screw being located within said firing pin passage and being received in threaded engagement by said breech face element.

* * * * *